US005921547A

United States Patent [19]

Wilner

[11] Patent Number: 5,921,547

[45] Date of Patent: Jul. 13, 1999

[54] GAME TICKET ASSEMBLY WITH PRINTED BAND

[75] Inventor: Joseph Wilner, Lenexa, Kans.

[73] Assignee: Universal Manufacturing Company, Inc., Kansas City, Mo.

[21] Appl. No.: 08/923,448

[22] Filed: Sep. 4, 1997

[51] Int. Cl.[6] ..... A63F 3/06

[52] U.S. Cl. ..... 273/139; 273/138.1; 283/100; 283/103; 283/106; 283/901; 283/903

[58] Field of Search ..... 273/139, 138.1; 283/100, 103, 106, 50, 52, 901, 903; 229/92, 92.1, 92.8, 87.15, 87.05

[56] References Cited

U.S. PATENT DOCUMENTS

| | | | |
|---|---|---|---|
| 3,900,219 | 8/1975 | D'Amato et al. | 273/139 |
| 4,943,090 | 7/1990 | Fienberg | 273/139 |
| 5,158,293 | 10/1992 | Mullins | 273/139 |

*Primary Examiner*—Benjamin H. Layno
*Attorney, Agent, or Firm*—Mark E. Brown; Litman, Kraai & Brown LLC

[57] ABSTRACT

A game ticket assembly is provided with a printed band whereby game symbols printed on the ticket are obscured and a commercial entity associated with the ticket is promoted. The trade name or logo of the commercial entity is printed on the band in a repeating confusion pattern and is observable by players.

8 Claims, 4 Drawing Sheets

GAME TICKET ASSEMBLY WITH PRINTED BAND

BACKGROUND OF THE INVENTION

1. Field of the Invention

The present invention relates generally to game tickets for playing games of chance, and in particular to a game ticket assembly and a play method with a multipurpose band printed with promotional indicia in a confusion pattern for advertising and security.

2. Description of the Prior Art

Various types of prior art devices have been used for playing games of chance for money and other prizes. For example, philanthropic, fraternal and social organizations often conduct charity gaming events for fundraising purposes. Moreover, various commercial establishments generate income and provide entertainment for their patrons by operating games of chance. Cards, tickets and other devices are commonly used to determine the game outcome at random or by chance.

Game symbols are often printed on such devices for identifying winners, losers and prize amounts. The game symbols can be concealed from the players until the game is in play, whereupon the concealed game symbols are somehow revealed to the players. For example, a set of game cards can be manufactured with a predetermined combination of winning and losing cards, as determined by combinations of game symbols printed thereon. The game symbols can be initially concealed by suitable concealing means, such as break-open windows or scratch-off coatings.

Another type of gaming device utilizes a set of game tickets printed with the game symbols and folded in such a way that the game symbols are concealed. The tickets can be used individually or in groups of multiple tickets fastened together. Such ticket assemblies can be secured together with the game symbols concealed until the ticket assemblies are bought and played. Ticket assemblies of this type are often sold from point-of-purchase displays. For example, a set of game tickets can be placed in a suitable receptacle, such as a jar. The jar can serve the dual purposes of displaying and holding a set of jar ticket assemblies. The game ticket assemblies can then be purchased at random from the jar and played.

Aesthetics are an important consideration in designing materials for playing games of chance. The game cards or tickets should help to promote the game by attracting players and stimulating player interest. Common devices for promoting a game of chance include point-of-sale advertising flares and artwork on the tickets themselves.

Another important consideration in designing game materials relates to security. With games of chance involving monetary and other prizes, game integrity and security are important considerations to prevent awarding unearned prizes and incurring loses. For games involving hidden game symbols, security measures typically involve concealing the game symbols until the card or ticket is purchased and played. One method of concealing a game symbol prior to play involves securing a band around folded parts of the game tickets. The band can comprise a fungible material, such as paper, and can be adhesively secured or stapled to the tickets.

Heretofore there has not been available a game ticket assembly with the advantages and features of the present invention in the areas of advertising the game and providing security therefor.

SUMMARY OF THE INVENTION

In the practice of the present invention, a game ticket assembly includes one or more individual game tickets. Each ticket is printed with a game symbol, which can comprise either a winning symbol or a losing symbol. The winning symbols can vary according to the prize amounts associated with each. The game materials form a set comprising a plurality of game ticket assemblies. The game tickets are folded to conceal the game symbols and are secured in their folded, closed configurations by a band printed with indicia in a confusion pattern for identifying a commercial entity associated with the game materials. The confusion pattern provides security by concealing the hidden game symbols.

OBJECTS AND ADVANTAGES OF THE INVENTION

The principle objects and advantages of the present invention include: providing a game material set with multiple game ticket assemblies; providing such game ticket assemblies with multiple or individual tickets; providing such game ticket assemblies with game symbol sections which have folded configurations prior to play and open configurations to reveal the hidden game symbols; providing such a game ticket assembly which includes a band releasably securing the game tickets in their folded configurations; providing such a game ticket assembly which includes confusion pattern printing on the band; providing such a game ticket assembly which facilitates game security through the confusion pattern printing on the band; providing such a game ticket assembly which includes promotional indicia associated with a commercial entity printed in a confusion pattern on the band; providing such a game ticket assembly which enhances player interest; providing such a game ticket assembly which enhances game security; providing such a game ticket assembly which can be manufactured on existing game ticket manufacturing equipment with preprinted bands; and providing such a game ticket assembly which is economical to manufacture, efficient in operation and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
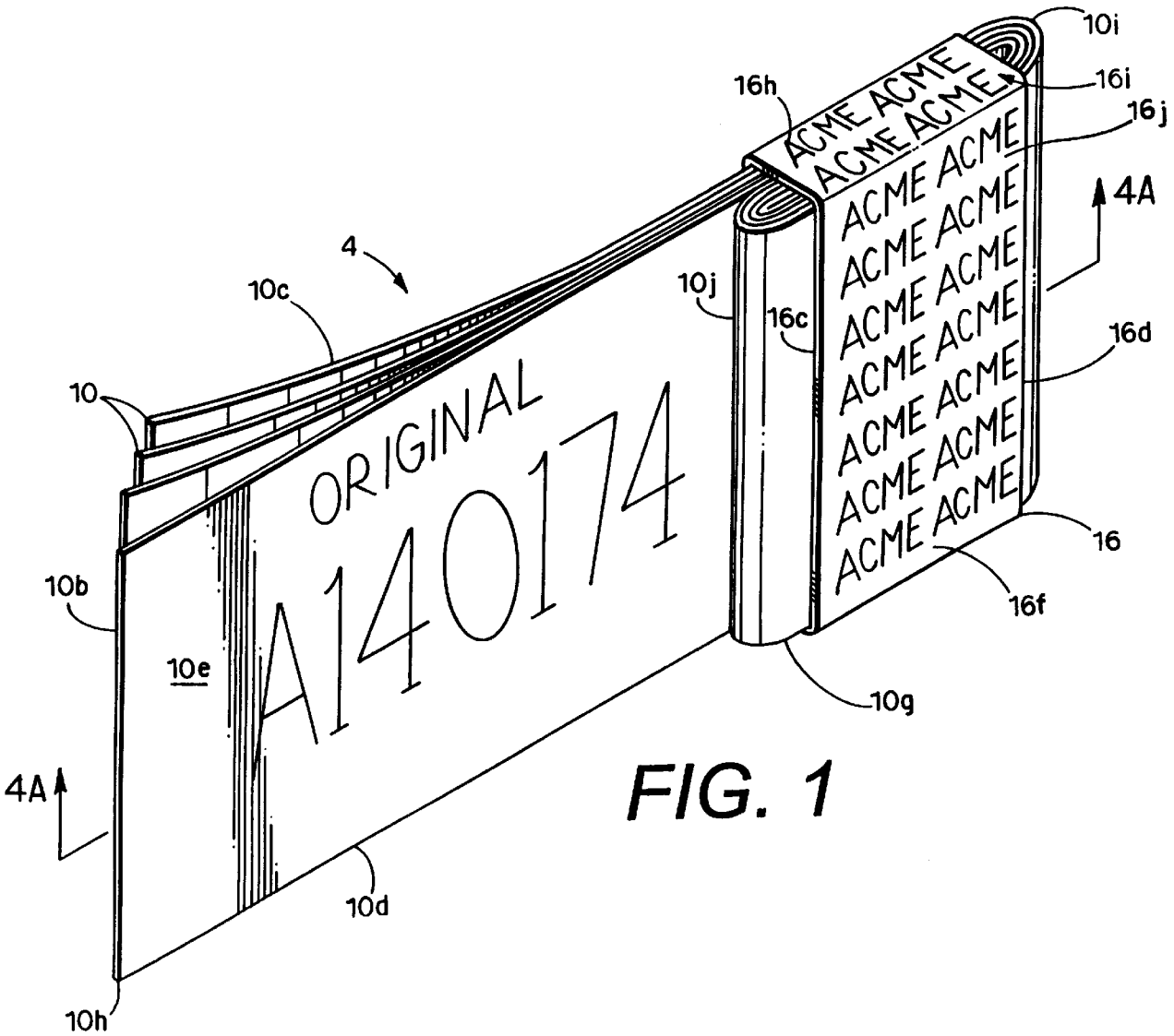
FIG. 1 is a perspective view of a game ticket assembly embodying the present invention, shown in a closed, concealed configuration with identifying indicia printed in a confusion pattern on a band thereof.
Figure 2:
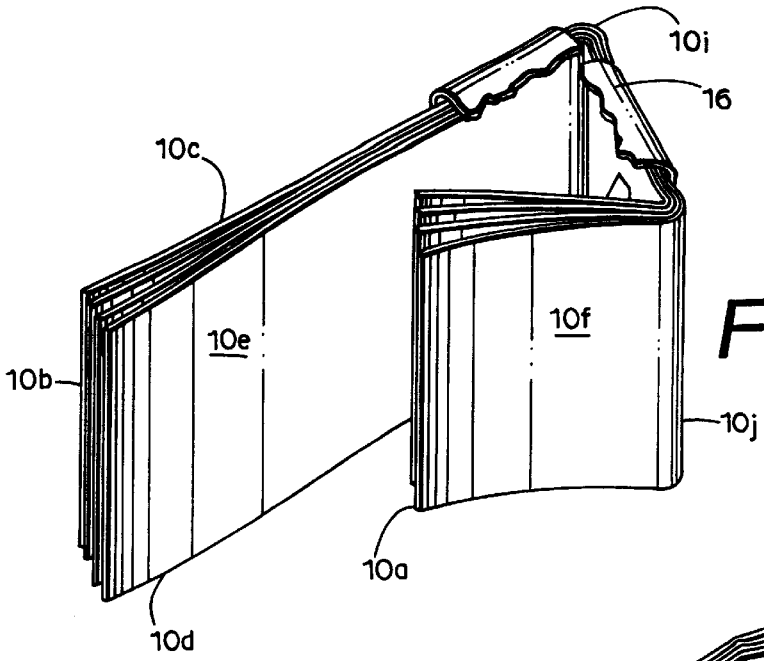
FIG. 2 is a perspective view of the game ticket assembly with the band broken and the tickets partially unfolded.
Figure 3:
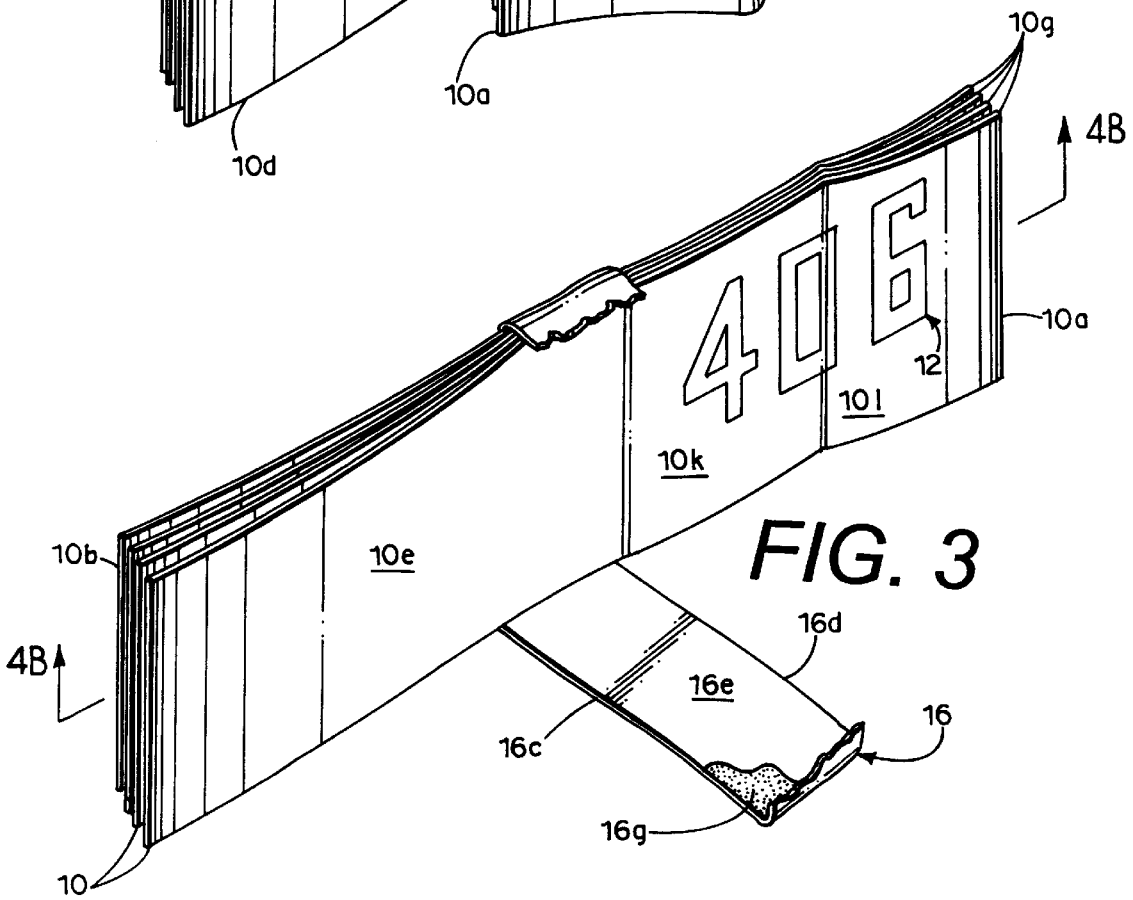
FIG. 3 is a perspective view of the game ticket assembly with the band broken and the tickets unfolded to an open configuration.
Figure 4B:
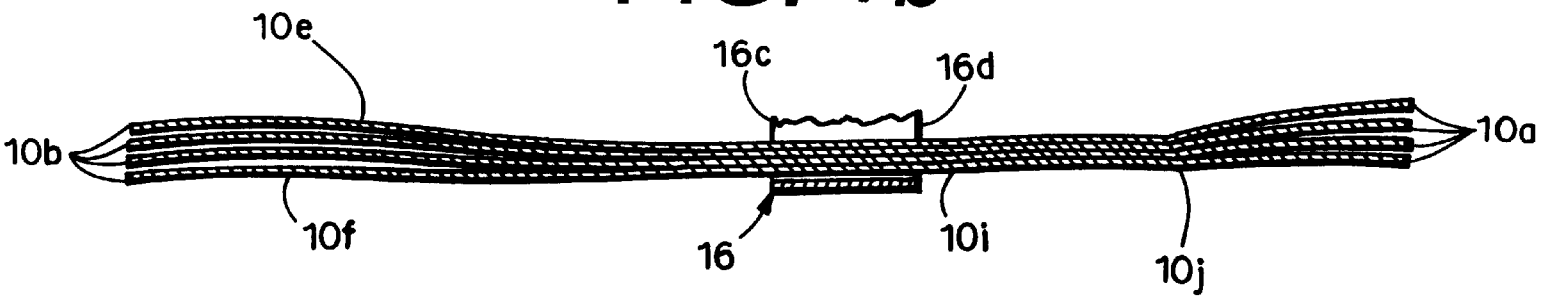
FIG. 4*b* is an enlarged, longitudinal cross-sectional view of the game ticket assembly taken generally along line 4*b*—4*b* in FIG. 3.
Figure 4A:
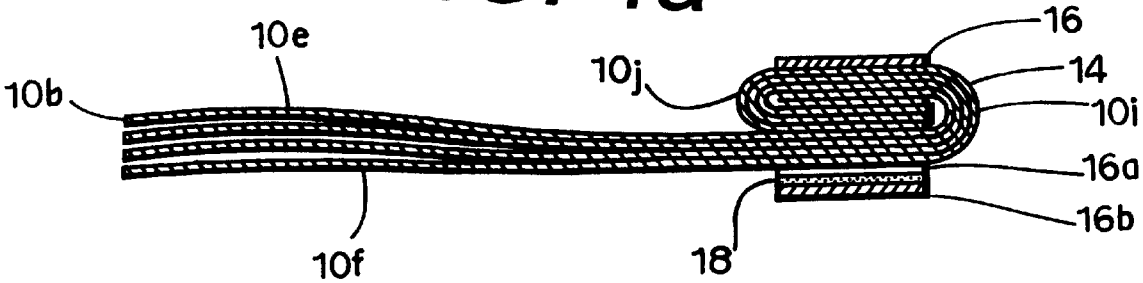
FIG. 4*a* is an enlarged, longitudinal cross-sectional view of the game ticket assembly taken generally along line 4*a*—4*a* in FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 4 generally designates a game ticket assembly embodying the present invention. A set of game ticket assemblies 4 are adapted for placement in an appropriate receptacle, such as a jar, from which the game ticket assemblies 4 can be extracted at random as they are purchased. A master game card or flare (not shown) identifying the winning game symbols and corresponding prize amounts can also be placed in the jar in view of the players.

II. Game Ticket Assembly 4

The game ticket assembly 4 includes one or more individual game tickets 10 each having game symbol and extension ends 10*a,b*; upper and lower edges 10*c,d*; and front and back faces 10*e,f*. Each game ticket 10 also includes game symbol and extension sections 10*g,h* adjacent to the game symbol and extension ends 10*a,b* respectively.

A first fold line 10*i* demarcates the game symbol and extension sections 10*g,h* respectively and a second fold line 10*j* located within the game symbol section 10*g* divides same into proximate and distal portions 10*k,l* respectively. The fold lines 10*i,j* extend between the upper and lower edges 10*c,d* and are generally parallel to the ends 10*a,b*. A game symbol 12 is printed on the inner face 10*e* in the game symbol section 10*g* and can comprise any one of the game symbols involved, including a winning symbol corresponding to a prize amount or a losing symbol.

The individual game tickets 10 can be used singly or in multiples to form game ticket assemblies 4. In manufacturing a multi-ticket configuration, the game tickets 10 can first be stacked in their open, unfolded configurations. They are then collectively folded along their second fold lines 10*j* and then collectively folded again along their first fold lines 10*i* whereby each individual ticket 10 forms a triple-thickness concealed end 14 of the game ticket assembly 4 in a closed position thereof.

The game ticket assembly 4 is retained in its closed position by a band 16. The band 16 has first and second ends 16*a,b*; first and second longitudinal edges 16*c,d* and inner and outer faces 16*e,f*. The band 16 has a width $W_B$ defined as the spacing between its edges 16*c,d*. $W_B$ is slightly less than the width $W_T$ of the ticket assembly concealed end 14, which approximates the spacing between the first fold line 10*i* and the second fold line 10*j*. The band inner face 16*e* can be printed with a relatively opaque coating 16*g*. For example, printing the band inner face 16*e* with black or some other suitable dark color can provide a degree of security by further concealing the hidden game symbol 12. The band is suitably fastened to the concealed end 14 by a fastener such as adhesive 18.

The game ticket assembly 4 described thus far is conventional and well-known in the prior art. The externally-printed band which, in combination with the other features of the game ticket assembly 4, forms the present invention, is described next.

The band outer face 16*f* is printed with a plurality of indicia 16*h* which can comprise, for example, the name (e.g., "ACME") of the manufacturer, distributor or dealer of the ticket assembly 4. The identifying indicia 16*h* forms a confusion pattern 16*i* on the band outer face 16*f*. The confusion pattern 16*i* is preferably relatively closely spaced with relatively small intermediate spaces 16*j* therebetween in order to provide the desired level of security.

Figure 5:
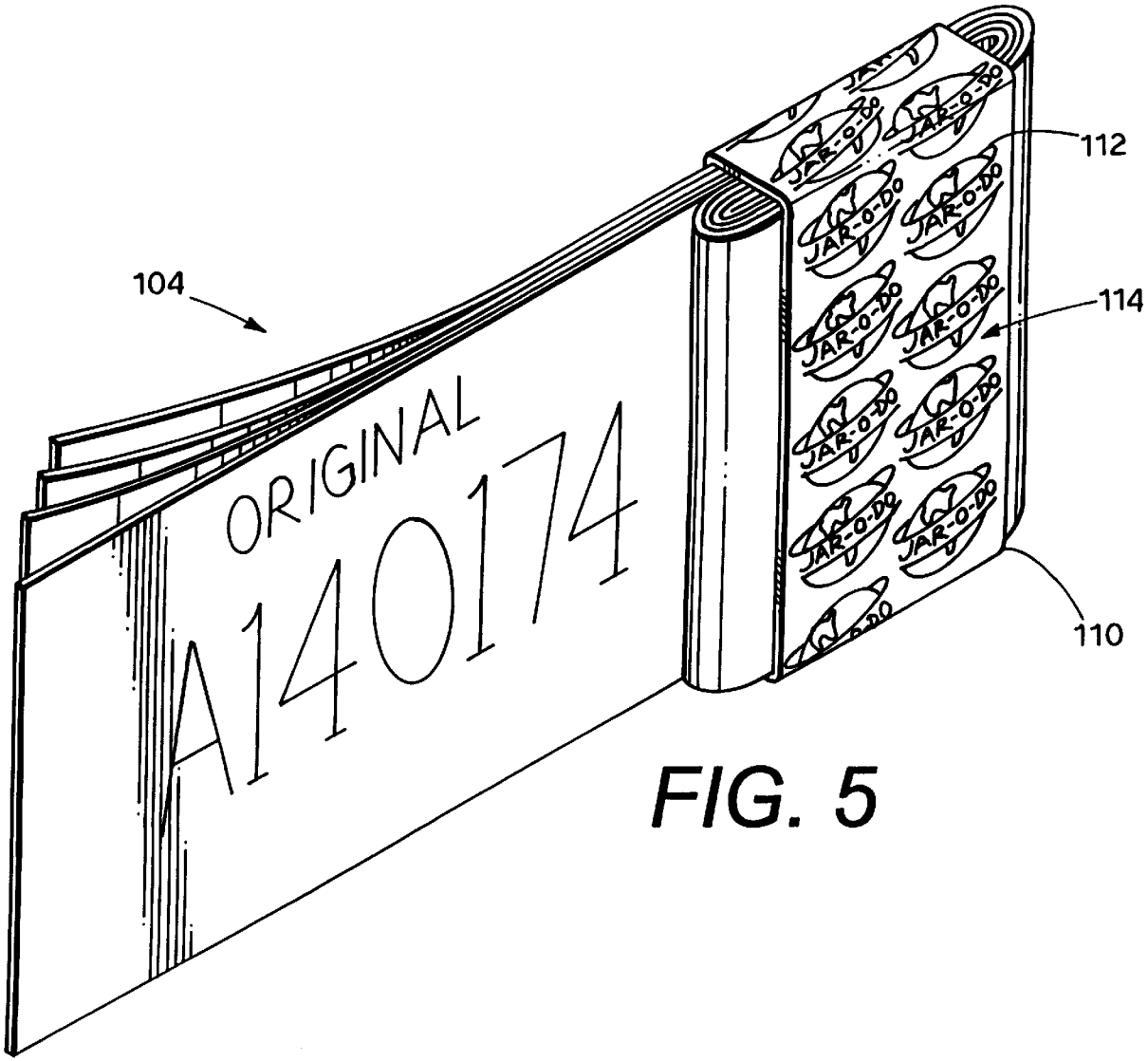
FIG. 5 is a perspective view of a game ticket assembly comprising a first modified embodiment of the present invention with promotional indicia comprising a logo printed in a confusion pattern on the band.

A game ticket assembly 104 comprising a first modified embodiment of the present invention is shown in FIG. 5 and includes a band 110 with a plurality of symbol indicia 112 printed thereon. The symbol indicia 112 can correspond, for example, to the logo of a source (e.g., manufacturer, distributor, etc.) of the game ticket assembly 104. By printing a confusion pattern 114 comprising symbol indicia 112 on the band 110, the security objective described above can be realized. Moreover, by using a logo or symbol associated with the source of the game ticket assembly 104, the band 110 can serve an advertising and promotional purpose. Since the outer surface of the band 110 is generally in plain view of a player, a commercial impression can be conveyed with the confusion pattern 114.

III. Operation

The game ticket assemblies 4 are typically sold individually for a predetermined price each for which the player receives a number of chances at winning which corresponds to the number of individual game tickets 10 in an assembly 4. The number of winning game symbols 12 in the game material set is based upon the prize amount or amounts and the total ticket count. A predetermined payout represents a percentage of all income received from ticket sales, with the remaining percentage representing the percentage profit.

In operation, the band 16 serves several purposes. First of all, it binds the individual game tickets 10 together at the concealed end 14 of a game ticket assembly 4.

Secondly, the band 16, in cooperation with the indicia 16*h* forming the pattern 16*i* thereon, functions to provide a measure of security to prevent learning the nature (i.e., winning or losing) of the game symbol 12 until the game ticket assembly 4 is purchased and opened by a player. The combination of the triple-folded concealed end 14, the confusion pattern 16*i* or 114 and the opaque band coating 16*g* cooperate to provide security. The concealed end 14 is folded in such a way that it cannot be opened without tearing or otherwise removing the band 16, thus providing a tamper-evident measure of security.

Still further, the band 16 prominently identifies the manufacturer, distributor or dealer of the game ticket assembly 4 by prominently displaying its indicia 16*h* or 112 in a confusion pattern **16*i* or 114. The indicia 16*h* or 112 provides a measure of security against counterfeit tickets which might be brought in from other sources to collect prizes, and further guards against viewing the hidden game symbols 12, for example, with the aid of a bright light, etc. The confusion pattern 16*h* or 112 formed by the indicia 16*i* tends to obscure the concealed game symbols 12. Thus, the possibility of the hidden game symbols 12** being detected is reduced.

It is to be understood that while certain forms of the present invention have been illustrated and described herein, it is not to be limited to the specific forms or arrangement of parts described and shown.

What is claimed and desired to be secured by Letters Patent is as follows:

1. A game ticket assembly, which includes:

(a) a game ticket including:

(1) an inner face;

(2) an outer face;

(3) a game symbol end;

(4) an extension end;

(5) a game symbol section adjacent said game symbol end;

(6) an extension section adjacent said extension end;

(7) a game symbol printed on said inner face in said game symbol section;

(8) a first fold line between said game symbol section and said extension section;

(9) a second fold line between said first fold line and said game symbol end within said game symbol section;

(10) said game symbol section having a proximate portion between said first and second fold lines and a distal portion between said second fold line and said game symbol end;

(11) a folded configuration with said game symbol section proximate portion folded over said extension section and said game symbol section distal portion folded between said extension section and said game symbol section proximate portion for a triple-thickness folded ticket end; and

(12) an open configuration with said game symbol section unfolded and extended; and (b) a band mounted on said game symbol section for retaining said game ticket in its folded configuration and having:

(1) a first end;

(2) a second end;

(3) an inner face;

(4) an outer face; and (5) indicia printed in a repeating confusion pattern on said band outer face, said indicia identifying a commercial entity and, said indicia substantially obscuring said game symbol with said game ticket in its folded configuration.

2. The game ticket assembly according to claim 1, which includes:

(a) an opaque, printed coating on said band inner face.

3. The game ticket assembly according to claim 1, which includes:

(a) said indicia printed on said band comprising the trade name of a commercial entity in a repeating confusion pattern.

4. The game ticket assembly according to claim 1, which includes:

(a) said indicia printed on said band comprising a logo associated with a commercial entity in a repeating, confusion pattern.

5. A method of promoting the sale of game ticket assemblies for use in playing a ticket game for monetary prizes, which comprises the steps of:

(a) printing a plurality of individual game tickets with a plurality of different game symbols;

(b) providing among said game symbols both winning and losing symbols;

(c) forming a plurality of game ticket assemblies by stacking a predetermined number of individual game tickets in each assembly;

(d) folding each said game ticket assembly along a plurality of first fold lines each associated with a respective individual game ticket to conceal said game symbols beneath a first layer of game ticket material;

(e) refolding each said game ticket assembly along a plurality of second fold lines each associated with a respective individual game ticket to provide a double layer of game ticket material covering each said game symbol;

(f) providing a plurality of paper bands, each said paper band having opposite ends, inner and outer faces and first and second longitudinal edges;

(g) printing each said band outer face with a confusion pattern comprising a repeating pattern of individual indicia identifying a commercial entity comprising a source of said game ticket assemblies; and (h) coating each said band inner face with adhesive and adhesively securing each said band over a respective game ticket assembly with said band in covering relation over said game symbol and said confusion pattern substantially obscuring said game symbol.

6. The method according to claim 5, which includes the additional step of:

(a) forming said confusion pattern with indicia comprising the name of the commercial entity.

7. The method according to claim 5, which includes the additional step of:

(a) forming said confusion pattern with indicia comprising the logo of the commercial entity.

8. A method of playing a game of chance for monetary prizes with game ticket assemblies associated with a particular commercial entity, which comprises the steps of:

(a) providing the commercial entity with a source-identifying indicia;

(b) providing a game set consisting of a plurality of game ticket assemblies, said game ticket assemblies being provided with a plurality of winning and losing game symbols;

(c) displaying said game ticket assemblies in a point-of-purchase display;

(d) providing each said game ticket assembly with;

(1) an inner face;

(2) an outer face;

(3) a game symbol end;

(4) an extension end;

(5) a game symbol section adjacent said game symbol end;

(6) an extension section adjacent said extension end;

(7) a game symbol printed on said inner face in said game symbol section;

(8) a first fold line between said game symbol section and said extension section;

(9) a second fold line between said first fold line and said game symbol end within said game symbol section;

(10) said game symbol section having a proximate portion between said first and second fold lines and a distal portion between said second fold line and said game symbol end;

(11) a folded configuration with said game symbol section proximate portion folded over said extension section and said game symbol section distal portion folded between said extension section and said game symbol section proximate portion for a triple-thickness folded ticket end; and

(12) an open configuration with said game symbol section extended;

(e) printing a band having inner and outer faces on over substantially the entire outer face thereof with a confusion pattern comprising a repeating pattern of an indicia identifying said commercial entity;

(f) obscuring said game symbols with said confusion pattern with said game ticket assembly in its closed configuration;

(g) adhesively securing said band ends together and to a respective ticket;

(h) breaking said band;

(i) unfolding said game ticket assembly to its open configuration;

(j) revealing said game symbols on said individual game tickets; and (k) awarding monetary prizes corresponding to said winning game symbols.

* * * * *